US005389579A

United States Patent [19]

Wells

[11] Patent Number: 5,389,579

[45] Date of Patent: Feb. 14, 1995

[54] METHOD FOR SINGLE SIDED POLISHING OF A SEMICONDUCTOR WAFER

[75] Inventor: Raymond C. Wells, Scottsdale, Ariz.

[73] Assignee: Motorola, Inc., Schaumburg, Ill.

[21] Appl. No.: 43,117

[22] Filed: Apr. 5, 1993

[51] Int. Cl.[6] ..... H01L 21/302; H01L 21/60

[52] U.S. Cl. ..... 437/225; 437/228; 437/966; 437/974; 156/636

[58] Field of Search ..... 437/228, 974, 946, 966, 437/225, 226; 148/DIG. 28, 33, DIG. 135; 51/131.1, 131.2, 131.3, 131.4, 131.5; 156/635-639

[56] References Cited

U.S. PATENT DOCUMENTS

| | | | |
|---|---|---|---|
| 3,953,255 | 4/1976 | Combs, Jr. | 437/62 |
| 4,144,099 | 3/1979 | Edmonds et al. | 437/974 |
| 5,159,787 | 11/1992 | Suenaga et al. | 51/131.3 |
| 5,162,260 | 11/1992 | Leibovitz et al. | 437/228 |
| 5,196,353 | 3/1993 | Sandhu et al. | 437/228 |
| 5,225,235 | 7/1993 | Yoshiharu | 428/64 |
| 5,227,339 | 7/1993 | Kishii | 437/225 |
| 5,232,875 | 8/1993 | Tuttle et al. | 437/228 |
| 5,245,794 | 9/1993 | Salugsugan | 51/165.74 |
| 5,284,803 | 2/1994 | Haisma et al. | 437/225 |

FOREIGN PATENT DOCUMENTS

| | | | |
|---|---|---|---|
| 54-15672 | 5/1979 | Japan | 437/946 |

*Primary Examiner*—George Fourson
*Assistant Examiner*—H. Jey Tsai
*Attorney, Agent, or Firm*—Gary W. Hoshizaki

[57] ABSTRACT

A method for polishing a single side of a semiconductor wafer (31) is disclosed for improving wafer flatness. A protective layer (32) is formed on one side of the semiconductor wafer (31). The semiconductor wafer (31) is polished on both sides concurrently using double sided polishing equipment (38,41). The protective layer (32) prevents a surface (37) of the semiconductor wafer (31) from being polished while the other unprotected surface (36) is polished thereby producing a single sided polished wafer.

12 Claims, 1 Drawing Sheet

METHOD FOR SINGLE SIDED POLISHING OF A SEMICONDUCTOR WAFER

BACKGROUND OF THE INVENTION

This invention relates, in general, to a method for polishing a semiconductor wafer and more particularly to a method for polishing a single surface of a semiconductor wafer extremely flat.

It is well known by those skilled in the art that semiconductor wafer surfaces are severely damaged by wafer thinning processes such as grinding to remove material. Semiconductor wafer polishing is a common method for removing damage from a wafer surface. Single sided wafer polishing equipment and double sided wafer polishing equipment is used by most semiconductor manufacturers. High quality single sided polishing is of particular importance to many semiconductor wafer users.

Several parameters are measured to determine the quality of a polished wafer. Total thickness variation (TTV) is the difference between the highest and lowest elevation of the polished surface of the semiconductor wafer. Taper is the lack of parallelism between the unpolished surface of the wafer and the selected focal plane. Total indicated reading (TIR) is the difference between the highest point above the focal plane and the lowest point below the focal plane (this measurement always yields a positive number). Focal plane deviation (FPD) is the greatest distance above or below the chosen focal plane (this measurement can be positive or negative). All the parameters listed above are measurements of wafer flatness. Wafer flatness is extremely important in the fabrication of high density, small geometry semiconductor devices.

Semiconductor wafers polished only on a single side are polished using a single sided wafer polishing equipment. Basically, single sided wafer polishing equipment comprises a holding chuck and a rotating element for polishing. A semiconductor wafer is placed between the holding chuck and the rotating element. The semiconductor wafer is held by the holding chuck. A polishing slurry is used in conjunction with the rotating element to remove a small amount of material from the semiconductor wafer surface leaving an undamaged surface. Single sided wafer polishing equipment is expensive and typically handles a single semiconductor wafer at a time. Single wafer handling provides a polished wafer output of typically only 10 wafers per hour. Single sided wafer polishing equipment also produces a defect on the semiconductor wafer surface commonly known as "dimpling". Finally, single sided wafer polishing equipment does not provide the required level of wafer flatness needed for the fabrication of small geometry devices.

It would be of great benefit if single sided polished wafers could be produced which reduced cost, increase throughput, and provide semiconductor wafers having less taper and increased flatness.

SUMMARY OF THE INVENTION

Briefly stated, this invention provides a method for polishing a single side of a semiconductor wafer.

A semiconductor wafer has a first surface and a second surface corresponding respectively to a first side and a second side. A layer of oxide is formed on the second surface. The semiconductor wafer is polished on the first and second side concurrently. The first surface of the semiconductor wafer is polished whereas the second surface is protected from being polished by the layer of oxide.

DETAILED DESCRIPTION OF THE PREFERRED EMBODIMENT

Figure 1:
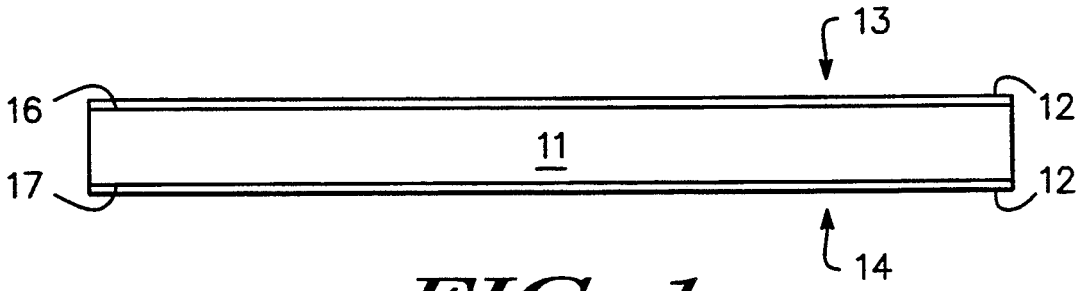
FIG. 1 is an illustration of oxide layers formed on either side of a semiconductor wafer.

FIG. 1 is an illustration of oxide layers 12 formed on a side 13 and a side 14 of a semiconductor wafer 11 using known integrated circuit processes.

In general, semiconductor wafers are polished to remove damage from a surface of a semiconductor wafer due to wafer process steps such as wafer grinding. A single surface or both surfaces of the semiconductor wafer are normally polished. For many applications a single polished surface is desirable. The methods for generating single sided polished wafers and double sided polished wafers are manufacturably distinct, each having positive and negative attributes. Both methods are well known by those skilled in the art.

Equipment cost, maintenance, and wafer throughput are critical components of any wafer polishing manufacture flow. The quality of the polishing step is of significant importance as wafer fabrication techniques produce ever decreasing device geometries. Variations in wafer height over the wafer surface, taper, wafer crowning, and overall flatness affect device quality and process yields. It is obviously desirable in the wafer polishing step to increase wafer throughput and to increase wafer flatness simultaneously.

The method for producing single sided polished wafers is well known by those skilled in the art. Single sided wafer polishing is typically handled by machinery which polishes a single wafer at a time although multiple wafer handling units are available. A chuck holds the single wafer while a rotating assembly along with a polishing slurry contacts the wafer surface to be polished. Polishing a single wafer at a time using single sided wafer polishing equipment is time consuming, producing about 10 wafers per hour. Furthermore, single sided polishing may not provide a wafer flatness suitable for some semiconductor wafer applications.

Double sided polishing equipment generally costs less than single sided wafer polishing equipment, provides semiconductor wafers of superior flatness, and has a higher throughput (approximately 80 wafers per hour). The problem resides in the fact that double sided polishing equipment produces wafers having both sides polished and is not used for single sided wafer polishing applications. Double sided wafer polishing machinery also operates differently than single sided wafer polishing equipment. Double sided polishing equipment handles multiple wafers simultaneously which accounts for the increase in throughput. Assemblies in conjunction with a polishing slurry polish both sides of a semiconductor wafer concurrently. The assemblies rotate in opposite directions from one another. Double sided polishing machines operating under these principles that are well known by those skilled in the art are the Speedfam line of polishing machines. A method is provided in this disclosure for increasing wafer throughput and producing wafers of superior flatness while polishing only a single side of a semiconductor wafer using double sided polishing equipment.

In an embodiment of the present invention, oxide layers 12 are grown on a surface 16 and a surface 17 corresponding respectively to a side 13 and a side 14 of semiconductor wafer 11 (FIG. 1). Oxide layers 12 are protective layers that are not significantly affected by a polishing process. Other suitable protective layers could also be used. Growing oxide layers on semiconductor wafers is well known in the processing arts. For example, oxide layers 12 are formed on surfaces 16 and 17 by placing semiconductor wafer 12 in an oxygen rich environment and controlling a thermal cycle in which oxide is grown. For example, semiconductor wafer 11 is a silicon semiconductor wafer having a starting thickness of 525 microns. Oxide layers 12 are grown having a thickness of approximately 8000 angstroms on surfaces 16 and 17. The actual thickness of oxide layers 12 may vary depending on wafer, polish, and polishing equipment type. Growing oxide layers 12 on surfaces 16 and 17 simplifies wafer processing since no patterning steps are used.

As mentioned previously, semiconductor wafers routinely have material removed to reduce wafer thickness prior to wafer processing. Material is removed from semiconductor wafer 11 by grinding away oxide layer 12 on side 13 and removing semiconductor material from surface 16 using a well known coarse grinding process. This coarse grinding process may damage surface 16. Next a fine grinding process is then performed to reduce any damage to surface 16. An alternate approach to reducing surface damage is to etch surface 16. Etching implies wafer processing and increased wafer handling while an additional grind step is easily accomplished. For example, 25 microns of material is removed by the two step grinding process. The grinding process yields a wafer thickness of 500 microns using the numbers from the example described above. However, the grinding leaves damage on surface 16 such that surface 16 must be prepared before any further wafer processing can occur. Wafer polishing is one method for preparing a damaged surface. Semiconductor wafer 11 having exposed surface 16 and oxide layer 12 on surface 17 is in a proper condition for double sided polishing.

Figure 2:
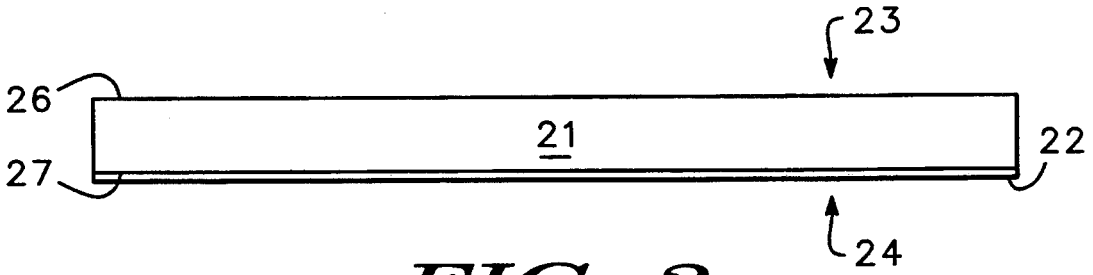
FIG. 2 is an illustration of a semiconductor wafer prepared for double sided polishing by having an oxide layer formed on a single surface in accordance with an embodiment of the invention.

FIG. 2 is an illustration of a semiconductor wafer 21 including an oxide layer 22 prepared for double sided polishing.

Semiconductor wafer 21 has an exposed surface 26 and a surface 27 corresponding respectively to a side 23 and a side 24. In the preferred embodiment, oxide layer 22 is formed only on surface 27 of semiconductor wafer 21 although wafer 11 (FIG. 1) can also be used once oxide layer 12 is removed using known techniques. Oxide layer 22 is a protective layer that is not significantly affected by a polishing process. Other types of protective layers can also be used that provide similar results. In this state, semiconductor wafer is prepared for double sided wafer polishing. Grinding surface 26 to remove material and expose surface 26 is one method for preparing wafer 22 for double sided polishing as described similarly in FIG. 1.

Other methods exist for forming oxide layer 22 on surface 27 of semiconductor 21. For example, oxide layers can be grown on both surfaces 26 and 27 similar to that described in FIG. 1. Photoresist is placed on oxide layer 22 and exposed. The photoresist protects oxide layer 22. Oxide grown on surface 26 is stripped away and then the photoresist protecting oxide layer 22 is removed. It should be obvious to one skilled in the art that many different methods for preparing semiconductor wafer 21 in the state illustrated in FIG. 2 exist and are too numerous to cite.

Figure 3:
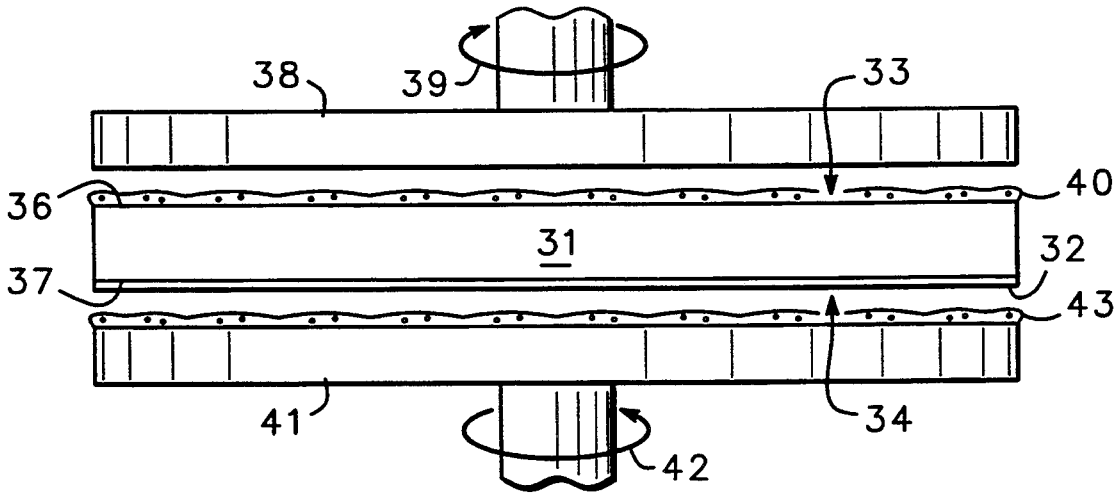
FIG. 3 is an illustration of a semiconductor wafer having both sides polished simultaneously.

FIG. 3 is an illustration of a semiconductor wafer 31 having both sides which otherwise are polished simultaneously.

Double sided polishing equipment is well known by those skilled in the art. Double sided polishing machines such as the Speedfaro line are capable of polishing multiple wafers simultaneously for increased throughput and providing wafers of superior flatness which is critical for processing small geometry devices. A unique feature of double sided polishing equipment is that the two rotating elements pressing the polishing slurry against the wafer surfaces rotate in opposite directions. The speed of rotation, duration of the polishing cycle, and composition of the polishing slurry are other factors that affect wafer flatness.

Illustrated in FIG. 3 is a simplified diagram of a double sided polishing mechanism. Semiconductor wafer 31 (corresponding to either wafer 11 (FIG. 1) with oxide layer 12 removed from side 13 or wafer 21 (FIG. 2)) having an exposed surface 36 and a surface 37 corresponding respectively to a side 33 and a side 34 and an oxide layer 32 formed on surface 37. In the preferred embodiment, double sided polishing equipment well known in the art such as the Speedfam line of polishers is used to perform single sided wafer polishing. Side 33 is polished while side 34 remains unpolished due to oxide layer 32.

A rotating element 38 polishes surface 36 using a polishing slurry 40. The polishing process removes a small amount of material from surface 36 leaving an undamaged semiconductor surface. Rotating element 38 rotates in a direction indicated by arrow 39. A rotating element 41 would normally polish surface 37 in a standard double sided polishing process. Surface 37 is not however polished. Oxide layer 32 acts as a protective layer for surface 37 from a polishing slurry 43 during the step of polishing surface 36. Rotating element 41 rotates in a direction indicated by arrow 42 which is opposite to the direction of rotation of rotating element 38. The critical component is that rotating elements 38 and 41 rotate in opposite directions. Sides 33 and 34 of semiconductor wafer 31 are polished concurrently providing benefits associated with standard double sided polishing process such as wafer flatness.

For example, semiconductor wafer 31 has a thickness of 500 microns. Polishing surface 36 using double sided polishing equipment removes approximately 5 microns of material reducing the thickness of semiconductor wafer 31 to 495 microns. Semiconductor wafer 31 is cleaned and oxide layer 32 is removed yielding a single sided polished wafer. In the preferred embodiment, oxide layer 32 is removed using an etching process well known in the industry. Thus, double sided polishing equipment and the benefits thereof can be used to produce single sided polished wafers.

By now it should be appreciated that a method for single sided wafer polishing has been provided utilizing a standard double sided polishing apparatus. The method reduces cost, increases wafer throughput, and provides single-sided polished wafers of superior flatness.

I claim:

1. A method for single sided polishing of a semiconductor wafer, the semiconductor wafer having a first surface and a second surface corresponding respectively to a first side and a second side, and a protective oxide layer formed on the second surface, the method comprising:

polishing the first and second sides of the semiconductor wafer concurrently such that the first surface is polished while the layer of oxide prevents the second surface from being polished.

2. A method for single sided polishing of a semiconductor wafer as recited in claim 1 wherein the step of polishing includes:

rotating elements for polishing the first and second sides in opposite directions.

3. A method for single sided polishing of a semiconductor wafer, the semiconductor wafer having a first and a second surface corresponding respectively to a first and a second side, the method comprising:

forming a protective layer on the second surface of the semiconductor wafer; and polishing the first and second sides of the semiconductor wafer concurrently, the first surface being polished whereas said protective layer prevents the second surface from being polished.

4. A method for single sided polishing of a semiconductor wafer as recited in claim 3 wherein said forming a protective layer step comprises growing an oxide layer on the first and second surface of the semiconductor wafer.

5. A method for single sided polishing of a semiconductor wafer as recited in claim 4 further including removing said oxide layer from the first surface of the semiconductor wafer.

6. A method for single sided polishing of a semiconductor wafer as recited in claim 5 wherein said removing said layer of oxide step comprises coarse grinding said oxide layer from the first surface and removing material from the first surface of the semiconductor wafer; and fine grinding the first surface of the semiconductor wafer.

7. A method for single sided polishing of a semiconductor wafer as recited in claim 5 wherein said removing said layer of oxide step comprises coarse grinding said oxide layer from the first surface and removing material from the first surface of the semiconductor wafer; and etching the first surface of the semiconductor wafer.

8. A method for single sided polishing of a semiconductor wafer as recited in claim 1 further including removing said protective layer from the second surface of the semiconductor wafer.

9. A method for single sided polishing of a semiconductor wafer as recited in claim 3 wherein said polishing the first and second sides of the semiconductor wafer concurrently step includes rotating elements for polishing the first and second sides in opposite directions.

10. A method for single sided polishing of a semiconductor wafer, the semiconductor wafer having a first and a second surface corresponding respectively to a first and a second side, the method comprising:

growing an oxide layer on the first and second surface of the semiconductor wafer;

coarse grinding the first side of the semiconductor wafer to remove the layer of thermal oxide on the first surface and to remove material from the first surface thereby thinning the semiconductor wafer;

fine grinding the first surface of the semiconductor wafer;

polishing the first and second sides of the semiconductor wafer concurrently, the first surface being polished whereas the oxide layer prevents the second surface from being polished.

11. A method for single sided polishing of a semiconductor wafer as recited in claim 10 wherein said polishing the first and second sides of the semiconductor wafer concurrently step includes rotating elements for polishing the first and second sides in opposite directions.

12. A method for single sided polishing of a semiconductor wafer as recited in claim 10 further including removing the oxide layer on the second surface of the semiconductor wafer.

* * * * *